US005516485A

United States Patent [19]

Culling

[11] Patent Number: 5,516,485

[45] Date of Patent: May 14, 1996

[54] WELDABLE CAST HEAT RESISTANT ALLOY

[75] Inventor: John H. Culling, St. Louis, Mo.

[73] Assignee: Carondelet Foundry Company, Pevely, Mo.

[21] Appl. No.: 214,649

[22] Filed: Mar. 17, 1994

[51] Int. Cl.[6] ..... C22C 30/00; C22C 19/05

[52] U.S. Cl. ..... 420/586; 420/448; 420/451; 420/454; 420/585; 148/427; 148/428; 148/442

[58] Field of Search ..... 420/448, 451, 420/454, 580, 586, 585; 148/427, 428, 442

[56] References Cited

U.S. PATENT DOCUMENTS

| | | | |
|---|---|---|---|
| 2,214,128 | 9/1940 | Fontana | 75/128 |
| 2,703,277 | 3/1955 | Spendelow et al. | 75/171 |
| 2,777,766 | 1/1957 | Binder | 75/134 |
| 2,857,266 | 10/1958 | Anger | 75/124 |
| 3,160,500 | 12/1964 | Eiseistein et al. | 75/171 |
| 3,758,294 | 9/1973 | Bellot et al. | 75/122 |
| 3,865,581 | 2/1975 | Sekino et al. | 75/122 |
| 4,063,934 | 12/1977 | Thuillier et al. | 75/122 |
| 4,077,801 | 3/1978 | Heyer et al. | 75/122 |
| 4,400,210 | 8/1983 | Kudo et al. | 420/443 |
| 4,662,920 | 5/1987 | Coupland et al. | 148/428 |
| 5,077,006 | 12/1991 | Culling | 420/584.1 |
| 5,310,522 | 5/1994 | Culling | 420/585 |

FOREIGN PATENT DOCUMENTS

| | | |
|---|---|---|
| 57-134536 | 2/1981 | Japan . |
| 59-38365 | 8/1982 | Japan . |

*Primary Examiner*—George Wyszomierski
*Assistant Examiner*—Sean Vincent
*Attorney, Agent, or Firm*—Senniger, Powers, Leavitt & Roedel

[57] ABSTRACT

Air meltable, weldable cast alloys of high hot strength and hot gas corrosion resistance especially in the service temperature range of about 1800° F. to 2100° F. which consist essentially of:

| | |
|---|---|
| Nickel | 41–54% by weight |
| Chromium | 24–29% |
| Iron | 8–18% |
| Cobalt | 3–8% |
| Tungsten | 4.5–6.5% |
| Molybdenum | 4–6.5% |
| Niobium | 0.8–2% |
| Manganese | 0.1–1.5% |
| Silicon | 0.1–1.5% |
| Carbon | 0.2–0.4% |

provided, that the nickel plus cobalt content is at least about 45%.

6 Claims, No Drawings

WELDABLE CAST HEAT RESISTANT ALLOY

BACKGROUND OF THE INVENTION

Most casting alloy development effort for several decades for alloys useful in the petrochemical and heat treatment applications has been directed toward improving the hot strength of such alloys. Weldability is also extremely important because large castings are welded together for original installations. Further, the industry has also shown great interest in alloys suitable for repair welding after extended periods of service but most current alloys have shown marked tendency to embrittle or lose cold ductility after service periods making repair welding impracticable.

The only practical weldable cast heat resistant alloys have been based upon various combinations of nickel, iron and chromium. Those alloys have often been enhanced by further additions of fractions of a percent up to several percent of one or more elements from the group, cobalt, tungsten, molybdenum, niobium, tantalum, titanium and zirconium and are generally deoxidized by approximately a percent or less each of silicon, manganese and, sometimes, aluminum. Those alloys derive their hot strengths partly by solid solution hardening and partly by formation of precipitated carbides. Such alloys, developed over a period of several decades and containing about 0.45% to 0.55% carbon, have had high hot strengths but have been found to be virtually unweldable by ordinary methods. Contrariwise, those alloys of about 0.40% or less carbon have been weldable but of generally much lower hot strengths than the higher carbon alloys. Thus, there remains a great demand for alloys having the weldability of the 0.40% or lower carbon content alloys but with the hot strengths achieved by the 0.45% to 0.55% carbon alloys and especially for such alloys that are capable of long term service in the 1800° F. to 2100° F. temperature range. This situation is illustrated by the data in Table 1 and Table 2 below which presents the published hot strengths of typical commercial alloys from both the high carbon and low carbon groups. Alloys above the dashed lines in each table are those that nominally contain about 0.45% or more carbon by weight, while those below the dashed lines are those that contain nominally 0.40% or less carbon.

TABLE 1

COMPOSITION OF CAST HEAT RESISTANT ALLOYS, WT. %

| Alloy Designation | C | Ni | Cr | Fe | Others |
|---|---|---|---|---|---|
| Supertherm | .50 | 35 | 28 | 15.5 | 15Co, 5W |
| HP Microalloyed | .45 | 35 | 25 | 37 | .5W, .25Nb, .10Ti |
| H110 | .55 | 33 | 30 | 29 | 4.5W, .5Nb, .10Ti |
| NA22H | .45 | 48 | 28 | 16 | 5W |
| HP50W2 | .50 | 35 | 25 | 32 | 5W, .5Zr |
| HP55 | .55 | 35 | 25 | 37 | — |
| More 2 | .20 | 50 | 33 | 0 | 16W, 1Al |
| HP-Nb | .40 | 35 | 25 | 36 | 1.5Nb |
| IN519 | .35 | 24 | 24 | 48 | 1.5Nb |
| IN625 | .20 | 63 | 22 | 2 | 9Mo, 4Nb + Ta |
| Hastelloy X | .10 | 48 | 22 | 18.5 | 9Mo, 1.5Co, .6W |
| CR30A | .06 | 51 | 30 | 15 | 2Mo, .2Ti, .14Al, .02Zr |

TABLE 2

10,000-HOUR RUPTURE STRESS AT VARIOUS TEMPERATURES, PSI

| Alloy Designation | 1800° F. | 1900° F. | 2000° F. | 2100° F. |
|---|---|---|---|---|
| Supertherm | 3800 | 2400 | 1300 | 650 |
| HP Microalloyed | 3000 | 1900 | 1100 | 500 |
| H110 | 2700 | 1750 | 900 | 450 |
| NA22H | 2500 | 1450 | 830 | 450 |
| HP50W2 | 2500 | 1400 | 750 | 400 |
| HP55 | 2500 | 1350 | 700 | 400 |
| More 2 | 2750 | 1650 | 1000 | 600 |
| HP-Nb | 2700 | 1600 | 830 | 450 |
| IN519 | 2300 | 1300 | 700 | 380 |
| IN625 | 2250 | 1100 | 650 | 400 |
| Hastelloy X | 1250 | 660 | 350 | 200 |
| CR30A | 1900 | 900 | 420 | 320 |

While More 2 alloy is presently formulated to contain less than 0.40% C, it is characterized by both high hot strength and lack of weldability comparable to the high carbon group of alloys. Thus, the sought after alloy is one that has hot strengths comparable to More 2 alloy or higher combined with the weldability of the other low-carbon alloys.

SUMMARY OF THE INVENTION

It is therefore an object of this invention to provide moderate cost, air meltable, weldable cast alloys of high hot strength and hot gas corrosion resistance especially in the service temperature range of about 1800° F. to 2100° F.

According to this invention alloys are provided which consist essentially of:

| | |
|---|---|
| Nickel | 41–54% by weight |
| Chromium | 24–29% |
| Iron | 8–18% |
| Cobalt | 3–8% |
| Tungsten | 4.5–6.5% |
| Molybdenum | 4–6.5% |
| Niobium | 0.8–2% |
| Manganese | 0.1–1.5% |
| Silicon | 0.1–1.5% |
| Carbon | 0.2–0.4% |

provided, that the nickel plus cobalt content is at least about 45%.

Optionally, the alloys of the invention may further contain:

| | |
|---|---|
| Titanium | up to 0.5% |
| Boron | up to 0.005% |
| Aluminum | up to 0.5% |

DETAILED DESCRIPTION OF THE INVENTION

In accordance with the present invention, alloys are provided which have high hot strength and excellent hot gas corrosion to 2100° F. combined with excellent weldability. They are air meltable and castable and of moderate cost.

In addition to having good weldability and high temperature hot strengths there are other advantages to the instant alloys due to the fact that they are iron containing alloys. Cobalt base superalloys are far too costly to be employable in the large cast-weld structures for which the alloys of the present invention are directed. Even the alloy known as Supertherm, which contains about 15% Co, has not proven to be cost effective in most applications even if its lack of weldability had not otherwise precluded its use. Even low cobalt or cobalt free, nickel-base alloys, whose iron contents are limited to less than about 3–4%, still tend to be expensive because their chromium contents must be attained through use of electrolytic chromium or other expensive pure chromium sources. Alloys of the present invention may employ the much less costly ferrochromium for most of their chromium contents. Also, tungsten, which is present in many commercial high hot strength alloys, has a very high melting point and it is not uncommon to find some undissolved tungsten remaining in the bottom of the furnace when pure tungsten metal is employed to make up tungsten-bearing alloys. In the case of the present alloys the lower melting ferrotungsten may be advantageously employed to more readily dissolve tungsten into the metallic solution. A third advantage of a substantial content of iron in alloys of the present invention is its apparent beneficial effect upon weldability. The fourth and most important advantage of the iron content of the alloys of the present invention is that their hot strengths are apparently enhanced by the amount of iron present.

A minimum of about 25% Cr is required in alloys of the invention to provide sufficient oxidation and other hot gas corrosion resistance up to about 2100° F. It is desirable to limit the alloys to a maximum of about 29% Cr in order to avoid formation of sigma phase. Nickel and cobalt favor the formation of an austenitic, or face-center matrix crystal structure. About 3% to 8% Co content in alloys of the invention has been found to provide much higher hot strengths than those of cobalt-free alloys in which Ni has been substituted for the cobalt content. A minimum combined content of about 45% Ni plus Co is required to insure the required austenitic matrix structure during long periods of exposure to high service temperatures. Provided that a minimum of at least 45% total of nickel plus cobalt is present in an alloy of the invention, nickel comprises essentially the balance when all of the other elements fall within the ranges set forth above.

The alloys of the invention derive their strengths in part by solid solution hardening of the austenitic matrix and in part by the formation of very stable carbide precipitates. Niobium enters principally into the carbides, while molybdenum and tungsten are mainly present in the matrices of alloys of the invention. The ranges of proportions of these three elements as set forth above have been found to provide optimum hot strengths along with matrix structural stability. Manganese, silicon and aluminum are all commonly employed as deoxidizers in air melting foundry practice and have been found to be suitable for this purpose without destabilizing the austenitic matrix structure when present in the ranges set forth above.

While alloys of the invention only contain between about 0.2 and about 0.4% C by weight, they not only have good weldability but also possess excellent hot strengths, an unexpected combination of properties. Up to about 0.005% B and/or about 0.5% Ti have been found to further increase hot strengths of some compositions of alloys of the invention, but higher contents of either element reduce weldability.

The following examples further illustrate the invention.

EXAMPLE 1

Four hundred pound heats of several different alloys were prepared in accordance with the invention. Flat 1"×6"×12" plates and 11" long×1" diameter bars were cast from each heat. The composition of these alloys is set forth in Table 3.

TABLE 3

| | ALLOYS OF THE INVENTION COMPOSITION BY WEIGHT PERCENTAGES | | | | | | | | | | | |
|---|---|---|---|---|---|---|---|---|---|---|---|---|
| Alloy | C | Ni | Co | Cr | Fe | W | Mo | Cb | Mn | Si | Ti | B |
| a | .37 | 44.70 | 4.39 | 24.15 | 11.80 | 6.01 | 5.94 | 1.36 | .50 | .67 | .11 | .001 |
| b | .28 | 43.11 | 5.06 | 26.14 | 12.36 | 6.26 | 4.57 | 1.46 | .45 | .46 | .13 | — |
| c | .31 | 45.18 | 5.11 | 27.96 | 9.08 | 6.11 | 4.25 | 1.02 | .66 | .51 | .12 | — |
| d | .26 | 41.77 | 5.85 | 25.86 | 12.61 | 5.84 | 4.85 | 1.87 | .71 | .56 | .08 | — |

Pairs of flat plates from each heat were welded together using a welding rod nominally composed of about 48% Ni, 28% Cr, 4.5% W, 2% Mn, 1.2% Si, 0.40% C and 15.9% Fe. The joined pairs of plates were then examined under a 10× magnifying glass. No cracks were observed either in the parent metal or in the weld metal.

EXAMPLE 2

Standard one-quarter inch diameter test bars were machined from pours of each of the alloys of Example 1. These test bars were then tested at elevated temperatures in air on standard creep-rupture frames of the cantilever load type. Various stress values at 1600° F., 1700° F., 1900° F. were applied until rupture. The hours to failure of these test bars are set forth in Table 4.

TABLE 4

| | HOURS TO FAILURE AT VARIOUS TEMPERATURES AND STRESSES | | |
|---|---|---|---|
| Alloy | 1600° F. 8000 PSI | 6000 PSI | 1700° F. 7000 PSI |
| a | 555.4 | — | — |
| b | — | 1650.4 | — |
| c | — | — | 284.2 |
| d | 508.9 | — | — |
| | 4500 PSI | 1800° F. 5000 PSI | 5500 PSI |
| a | — | 1386.5 | — |
| b | 2802.5 | — | — |
| c | — | 713.2 | 285.6 |
| d | — | 921.7 | — |
| | 3000 PSI | 1900° F. 40000 PSI | 5000 PSI |
| a | — | 528.9 | 88.9 |
| b | — | 626.1 | — |
| c | 2225.7 | — | 125.2 |

TABLE 4-continued

| HOURS TO FAILURE AT VARIOUS TEMPERATURES AND STRESSES | | | | |
|---|---|---|---|---|
| d | — | 366.8 | — | |
| | | 20000° F. | | |
| Alloy | 2000 PSI | 2300 PSI | 2500 PSI | 3000 PSI |
| a | — | 1786.6 | — | 505.1 |
| b | 2562.6 | — | 806.3 | 289.1 |
| c | — | — | 1118.9 | — |
| d | — | — | 927.9 | 331.4 |

TABLE 5

| MEAN RUPTURE STRESS FOR ALLOYS OF THE INVENTION AT VARIOUS TEMPERATURES, PSI | | | | |
|---|---|---|---|---|
| Rupture Time | 1800° F. | 1900° F. | 2000° F. | 2100° F. |
| 1,000 Hours | 5000 | 3500 | 2500 | 1450 |
| 10,000 Hours | 3500 | 2500 | 1450 | 750 |
| 100,000 Hours | 2500 | 1450 | 750 | 400 |

A comparison of the data from the foregoing Examples with the data for present commercial alloys as set forth in Table 2 above establish that the alloys of the invention combine weldability with hot strengths in the 1800° F. to 2100° F. temperature range that exceed those of even the unweldable high-carbon prior art alloys.

As various changes could be made in the above described alloy without departing from the spirit and scope of the invention, it is intended that all matter contained in the above description shall be interpreted as illustrative and not in a limiting sense.

What is claimed is:

1. A Ni—Cr—Fe alloy consisting of:

| | |
|---|---|
| Nickel | 41–54% by weight |
| Cobalt | 3–8% |
| Chromium | 24–29% |
| Iron | 8–18% |
| Tungsten | 4.5–6.5% |
| Molybdenum | 4–6.5% |
| Niobium | 0.8–2% |
| Manganese | 0.1–1.5% |
| Silicon | 0.1–1.5% |
| Carbon | 0.2–0.4% |
| Titanium | up to 0.5% |
| Boron | up to 0.005% |
| Aluminum | up to 0.5% |

provided that the nickel plus cobalt content is at least about 45%, the alloy being meltable and castable in air and having good high temperature hot strength.

2. A Ni—Cr—Fe alloy as set forth in claim 1 consisting of:

| | |
|---|---|
| Nickel | 43–46% |
| Cobalt | 4–6% |
| Chromium | 24–26% |
| Iron | 9–13% |
| Tungsten | 6–6.5% |
| Molybdenum | 4–6% |

-continued

| | |
|---|---|
| Niobium | 1–1.9% |
| Manganese | 0.4–0.75% |
| Silicon | 0.45–0.7% |
| Titanium | up to 0.2% |
| Carbon | 0.27–0.38% |

3. An alloy of claim 1 consisting of:

| | |
|---|---|
| Carbon | .37% |
| Nickel | 44.70% |
| Cobalt | 4.39% |
| Chromium | 24.15% |
| Iron | 11.80% |
| Tungsten | 6.01% |
| Molybdenum | 5.94.% |
| Niobium | 1.36% |
| Manganese | .50% |
| Silicon | .67% |
| Titanium | .11% |
| Boron | .0011% |

4. An alloy of claim 1 consisting of:

| | |
|---|---|
| Carbon | .28% |
| Nickel | 43.11% |
| Cobalt | 5.06% |
| Chromium | 26.14% |
| Iron | 12.36% |
| Tungsten | 6.26% |
| Molybdenum | 4.57% |
| Niobium | 1.46% |
| Manganese | .45% |
| Silicon | .46% |
| Titanium | .13% |

5. An alloy of claim 1 consisting of:

| | |
|---|---|
| Carbon | .31% |
| Nickel | 45.18% |
| Cobalt | 5.11% |
| Chromium | 27.96% |
| Iron | 9.08% |
| Tungsten | 6.11% |
| Molybdenum | 4.25% |
| Niobium | 1.02% |
| Manganese | .66% |
| Silicon | .51% |
| Titanium | .12% |

6. An alloy of claim 1 consisting of:

| | |
|---|---|
| Nickel | 41.77% |
| Cobalt | 5.85% |
| Chromium | 25.86% |
| Iron | 12.61% |
| Tungsten | 5.84% |
| Molybdenum | 4.85% |
| Niobium | 1.87% |
| Manganese | .71% |
| Silicon | .56% |
| Carbon | .26% |
| Titanium | .08% |

* * * * *